US008212758B2

(12) United States Patent
Yen

(10) Patent No.: US 8,212,758 B2
(45) Date of Patent: Jul. 3, 2012

(54) SOURCE DRIVER AND DISPLAY UTILIZING THE SOURCE DRIVER

(75) Inventor: Yu-Jen Yen, Tainan County (TW)

(73) Assignee: Himax Technologies Limited, Fonghua Village, Xinshi Dist., Tainan (TW)

( * ) Notice: Subject to any disclaimer, the term of this patent is extended or adjusted under 35 U.S.C. 154(b) by 469 days.

(21) Appl. No.: 12/629,063

(22) Filed: Dec. 2, 2009

(65) Prior Publication Data

US 2010/0283712 A1 Nov. 11, 2010

Related U.S. Application Data

(63) Continuation-in-part of application No. 12/463,436, filed on May 11, 2009.

(51) Int. Cl.
*G09G 3/36* (2006.01)

(52) U.S. Cl. ..... 345/99; 345/100

(58) Field of Classification Search ..... 345/99, 345/100

See application file for complete search history.

(56) References Cited

U.S. PATENT DOCUMENTS

| | | | | |
|---|---|---|---|---|
| 5,543,744 | A * | 8/1996 | Okumura | 327/333 |
| 5,621,342 | A | 4/1997 | Wong | |
| 5,929,656 | A | 7/1999 | Pagones | |
| 2006/0284662 | A1 * | 12/2006 | Suda et al. | 327/261 |
| 2009/0073148 | A1 | 3/2009 | Hsueh | |
| 2010/0167678 | A1 | 7/2010 | Yoshikawa | |

* cited by examiner

*Primary Examiner* — Kevin M Nguyen
(74) *Attorney, Agent, or Firm* — Winston Hsu; Scott Margo

(57) ABSTRACT

A source driver includes a receiver for receiving a digital signal at an input node to generate an output signal at an output node, where the receiver includes a first switch, a second switch, a voltage-limiting circuit, a third switch and a channel. The first switch is for selectively connecting the output node of the receiver to a first reference voltage based on the digital signal. The second switch is for selectively connecting the output node of the receiver to a second reference voltage based on the digital signal. The voltage-limiting circuit is coupled between the input node and the output node of the receiver, and is for limiting a voltage level of the input node of the receiver. The third switch is coupled between the voltage-limiting circuit and the output node of the receiver. The channel is for generating a driving voltage based on the output signal.

15 Claims, 8 Drawing Sheets

SOURCE DRIVER AND DISPLAY UTILIZING THE SOURCE DRIVER

CROSS REFERENCE TO RELATED APPLICATIONS

This continuation-in-part application claims the benefit of co-pending U.S. application Ser. No. 12/463,436, filed on May 11, 2009, which is incorporated herein by reference.

BACKGROUND OF THE INVENTION

1. Field of the Invention

The present invention relates to a transmitter and a receiver, and more particularly, to a transmitter and a receiver of a display.

2. Description of the Prior Art

Please refer to FIG. 1. FIG. 1 is a diagram illustrating a transistor-transistor logic (TTL) interface 100. As shown in FIG. 1, the interface 100 includes a transmitter 110 and a receiver 120, where the receiver 120 receives a digital signal via a single data line L. The TTL interface 100 has good noise immunity; however, the digital signal generally requires a large swing, therefore electro-magnetic interference (EMI) is serious and an operating frequency is limited.

To solve the EMI and operating frequency issues in the TTL interface 100, a circuit for reduced swing differential signaling (RSDS) is utilized. FIG. 2 is a diagram illustrating a prior art circuit 200 for RSDS. As shown in FIG. 2, the circuit 200 includes a transmitter 210 and a receiver 220, where the receiver 220 is coupled to the transmitter 210 via a data line pair. The circuit 200 has better EMI and operating frequency due to smaller swings of signals carried on the data line pair. However, current sources $I_{S1}$ and $I_{S2}$ in the transmitter 210 require higher supply currents (about 2 mA) to the data line pair, causing increased power consumption. Furthermore, the number of data lines is doubled compared with the TTL interface 100, which increases the manufacturing cost.

SUMMARY OF THE INVENTION

It is therefore an objective of the present invention to provide a display comprising a timing controller and a source driver, where the display has a TTL mode and a CMRS mode, to solve the above-mentioned problems.

According to one embodiment of the present invention, a source driver comprises a receiver for receiving a digital signal at an input node to generate an output signal at an output node, where the receiver comprises a first switch, a second switch, a voltage-limiting circuit, a third switch and a channel. The first switch is utilized for selectively connecting the output node of the receiver to a first reference voltage based on the digital signal. The second switch is utilized for selectively connecting the output node of the receiver to a second reference voltage based on the digital signal. The voltage-limiting circuit is coupled between the input node and the output node of the receiver, and is utilized for limiting a voltage level of the input node of the receiver. The third switch is coupled between the voltage-limiting circuit and the output node of the receiver. The channel is utilized for generating a driving voltage based on the output signal.

According to another embodiment of the present invention, a display comprises a timing controller for receiving an input signal at an input node and generating a digital signal at an output node, and a source driver. The timing controller comprises a first P-type transistor, a first N-type transistor, a first switch, a second switch, a third switch, a fourth switch, and an inverter. The first P-type transistor is coupled between a first current source and the output node of the timing controller; the first N-type transistor is coupled between a second current source and the output node of the timing controller; the first switch is coupled between a gate electrode of the P-type transistor and the input node of the timing controller; the second switch is coupled between a gate electrode of the N-type transistor and the input node of the timing controller; the third switch is coupled between the gate electrode of the P-type transistor and a first reference voltage; the fourth switch is coupled between the gate electrode of the N-type transistor and a second reference voltage; and the inverter is coupled between the input node and the output node of the timing controller. In addition, the source driver comprises a receiver, which is coupled to the output node of the timing controller via a single data line, and is utilized for receiving the digital signal from the timing controller via the single data line.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . " The terms "couple" and "couples" are intended to mean either an indirect or a direct electrical connection. Thus, if a first device couples to a second device, that connection may be through a direct electrical connection, or through an indirect electrical connection via other devices and connections.

Figure 1:
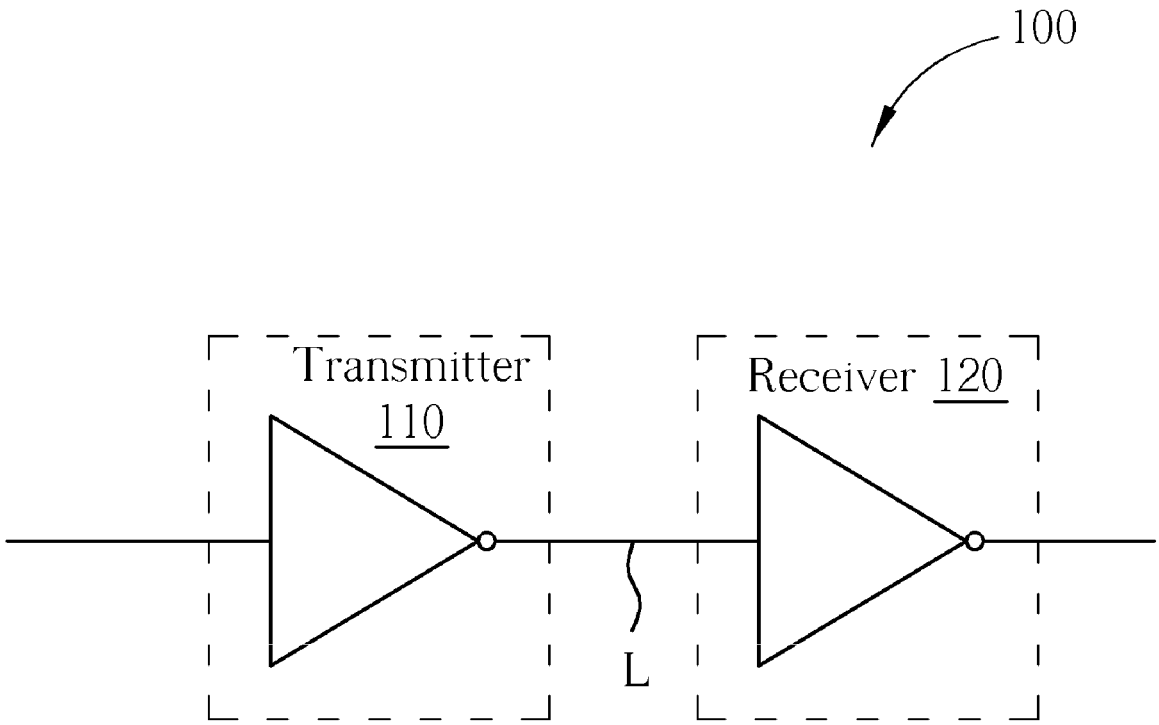
FIG. 1 PRIOR ART
FIG. 1 is a diagram illustrating a TTL.
Figure 2:
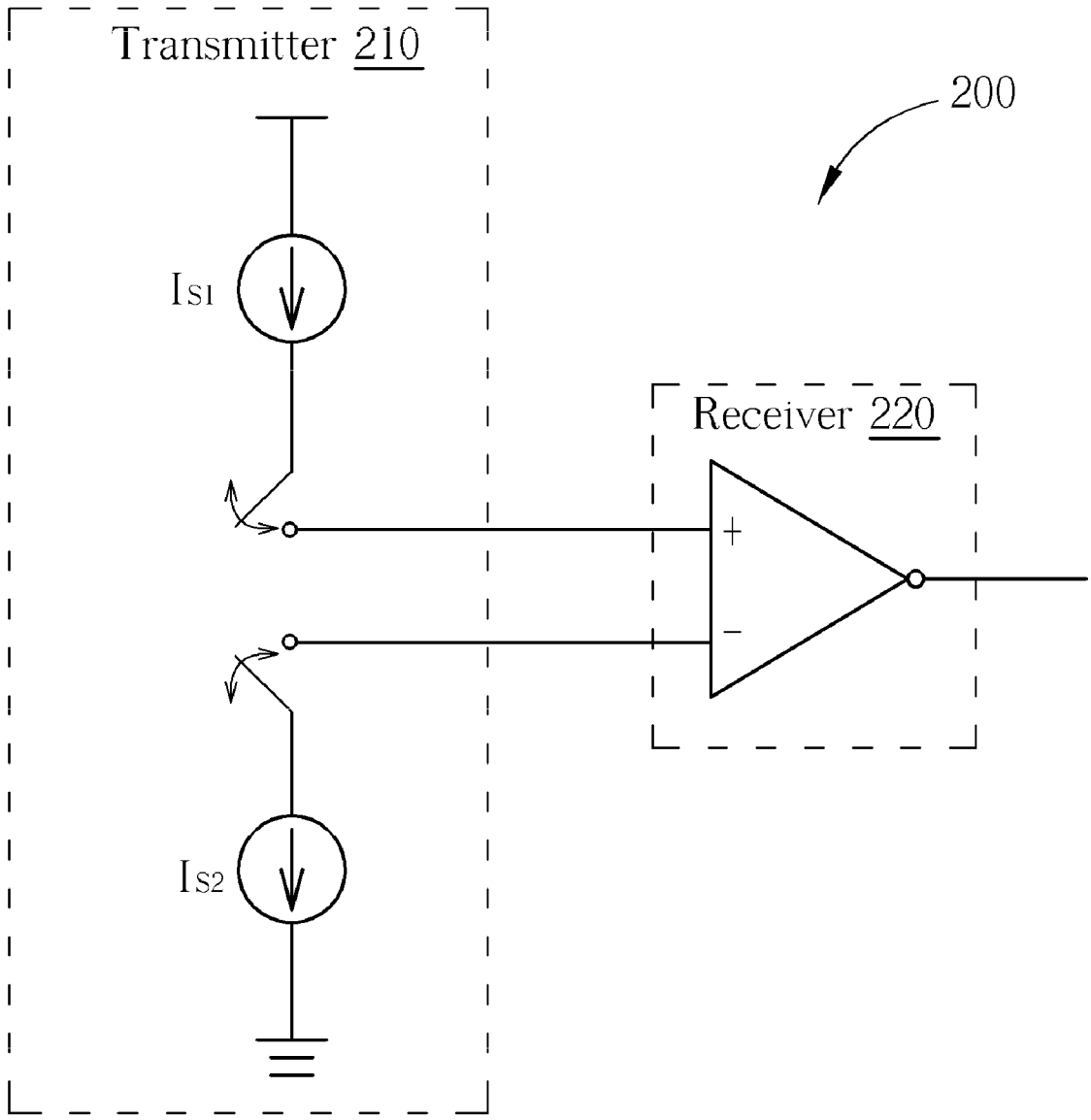
FIG. 2 PRIOR ART
FIG. 2 is a diagram illustrating a prior art circuit for RSDS.
Figure 3:
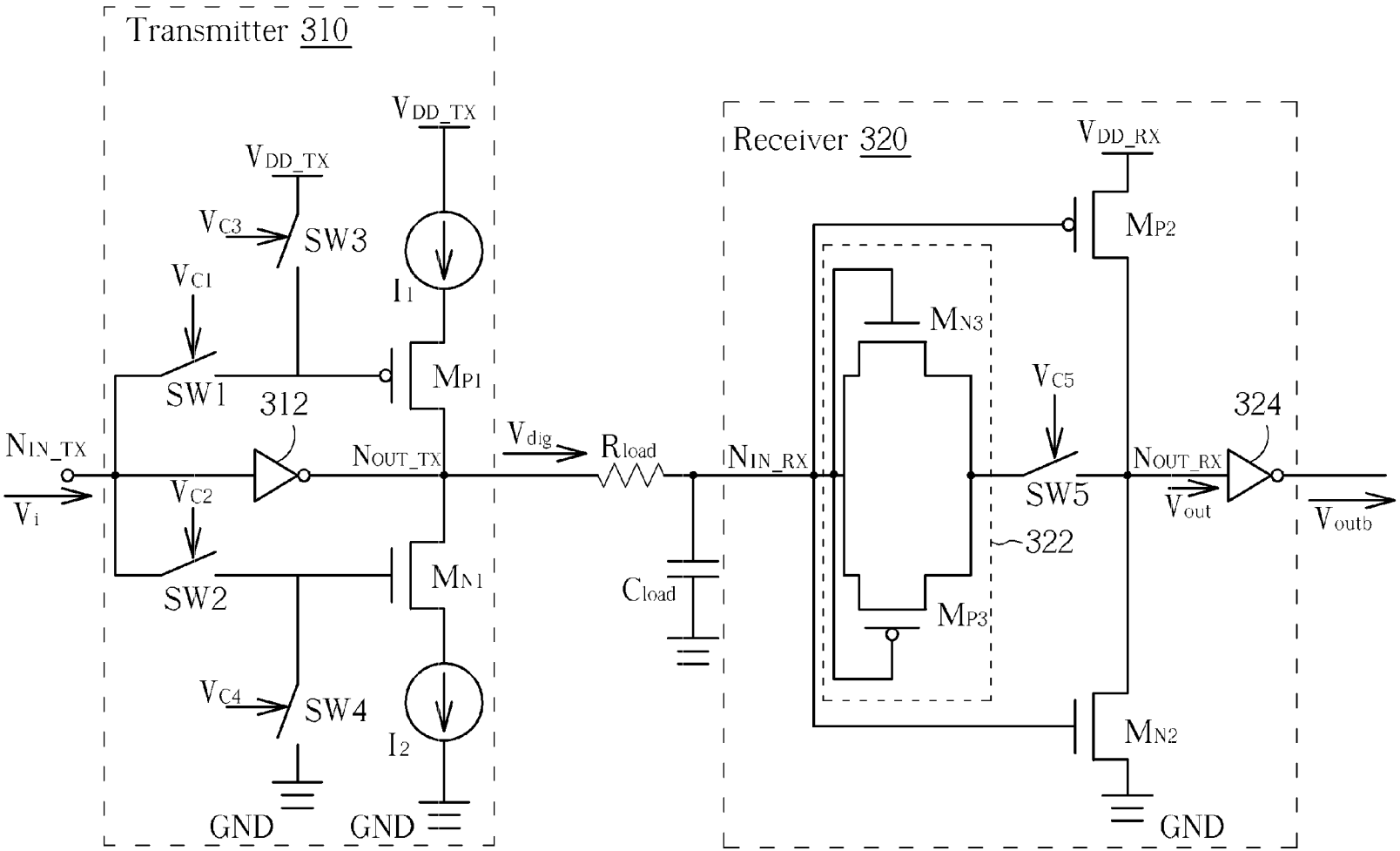
FIG. 3 is a diagram illustrating a transmitter in a timing controller and a receiver in a source driver of a display.

Please refer to FIG. 3. FIG. 3 is a diagram illustrating a transmitter 310 and a receiver 320 according to an embodiment of the invention. The transmitter 310 can be used in a timing controller of a display, while the receiver 320 can be used in a source driver of the display. As shown in FIG. 3, the transmitter 310 includes a P-type transistor $M_{P1}$, an N-type transistor $M_{N1}$, an inverter 312, four switches SW1-SW4, and current sources $I_1$ and $I_2$. The current source $I_1$ is coupled between a reference voltage $V_{DD_TX}$ and a source electrode of the P-type transistor $M_{P1}$, and the current source $I_2$ is coupled between a reference voltage GND and a source electrode of the N-type transistor $M_{N1}$.

The receiver 320 includes a switch implemented by a P-type transistor $M_{P2}$, a switch implemented by an N-type transistor $M_{N2}$, a switch SW5, a voltage-limiting circuit 322 and an inverter 324, where the inverter 324 is an optional device. Additionally, the voltage-limiting circuit 322 includes a diode-connected N-type transistor $M_{N3}$ and a diode-connected P-type transistor $M_{P3}$. Furthermore, the transmitter 310 is coupled to the receiver 320 via a single data line, where a resistor $R_{load}$ and a capacitor $C_{load}$ shown in FIG. 3 respectively represent an equivalent parasitic resistance and an equivalent parasitic capacitance of the single data line.

Figure 4:
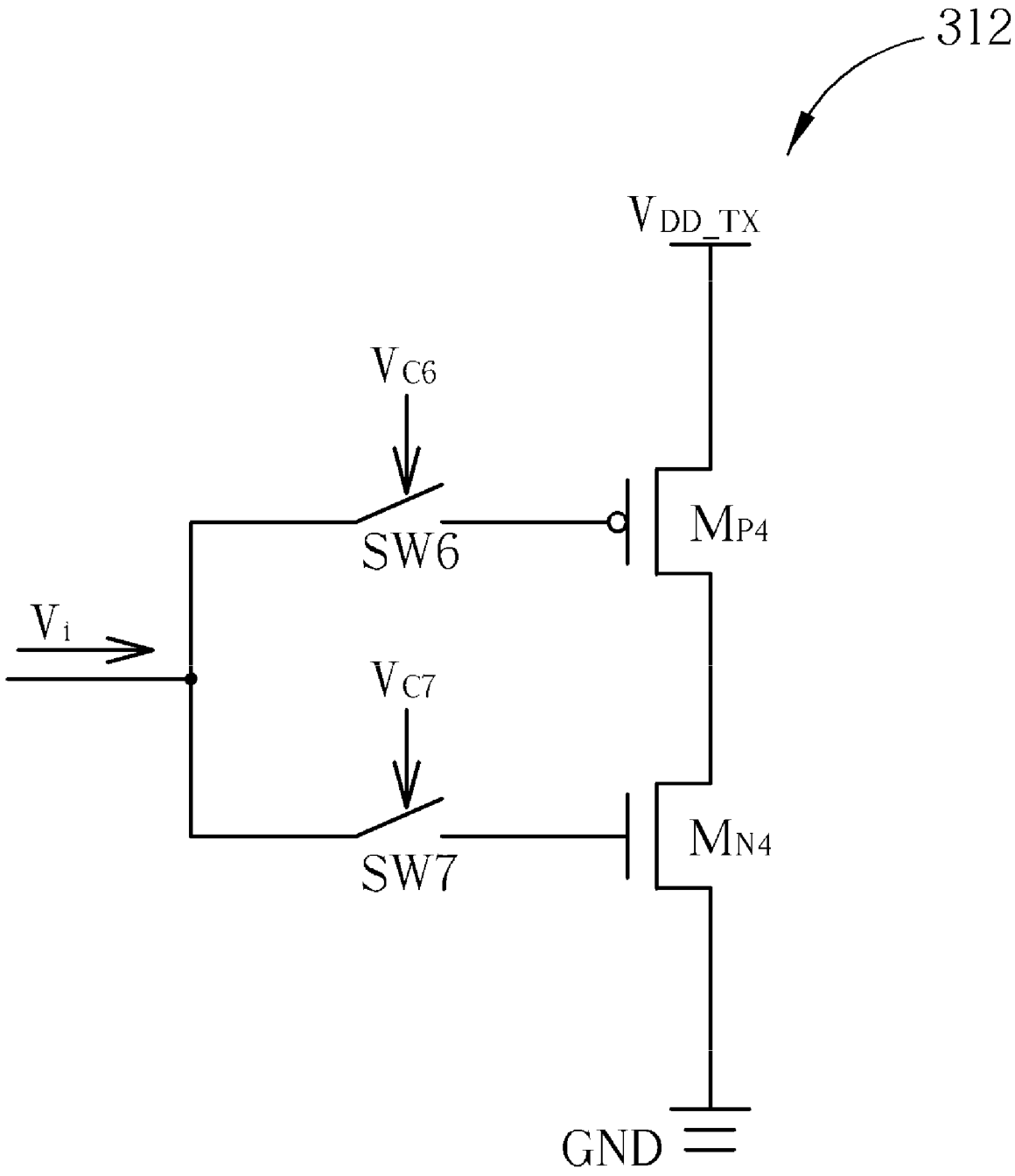
FIG. 4 is a diagram illustrating the inverter shown in FIG. 3

In addition, FIG. 4 is a diagram illustrating the inverter 312 shown in FIG. 3 according to one embodiment of the present invention. The inverter 312 includes a P-type transistor $M_{P4}$, an N-type transistor $M_{N4}$, and two switches SW6 and SW7.

In addition, the switches SW1-SW7 shown in FIG. 3 and FIG. 4 can be implemented by MOS transistors, transmission gates or any other type of switches, and the switches SW1-SW7 are controlled by control signals $V_{C1}$-$V_{C7}$, respectively.

Figure 5:
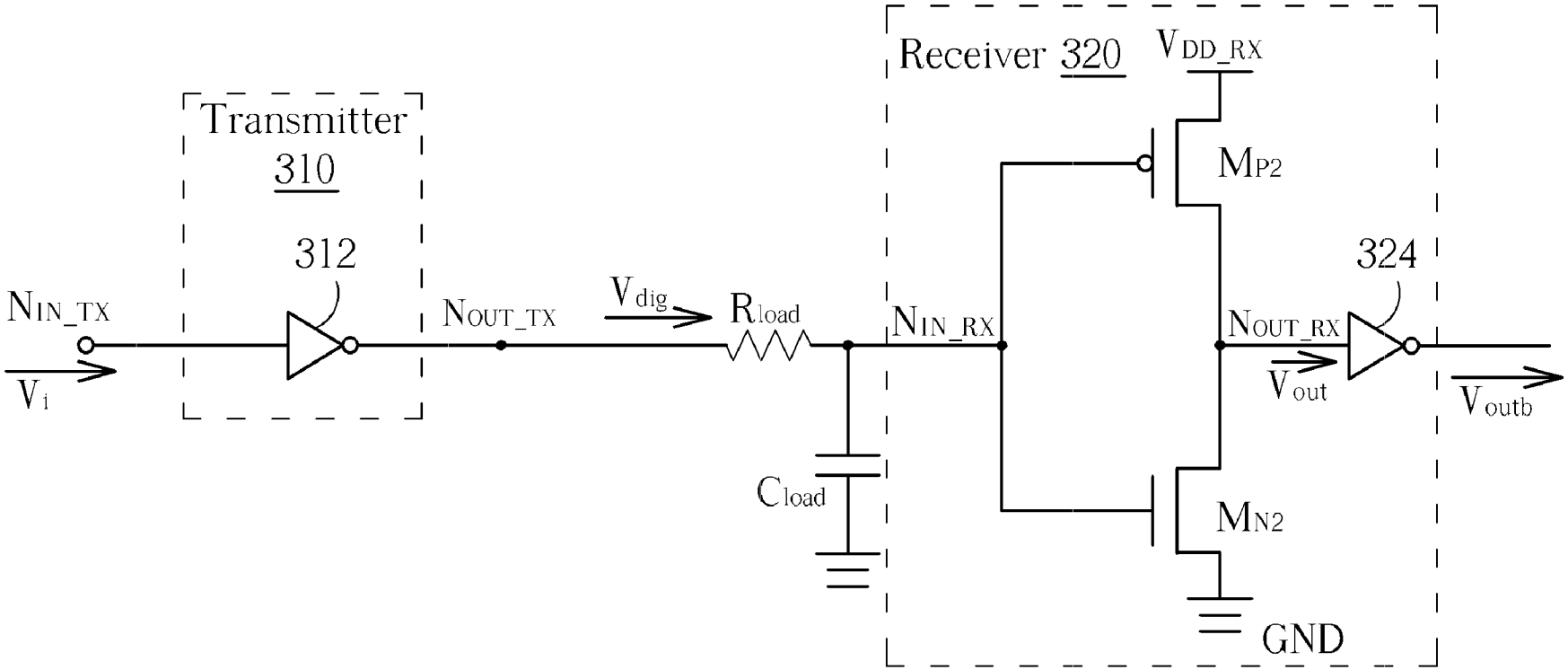
FIG. 5 is an equivalent circuit of the transmitter in the timing controller and the receiver in the source driver shown in FIG. 3 when it is in a TTL mode.

In the operations of the transmitter 310 and the receiver 320, each of the switches SW1-SW7 can be switched on or off to switch the modes of the transmitter 310 and the receiver 320. In this embodiment, the transmitter 310 and the receiver 320 can be operated in a TTL mode or a CMRS (current mode reduced swing) mode. When the transmitter 310 and the receiver 320 are set to be operated in the TTL mode, the switches SW1, SW2 and SW5 are switched off, and the switches SW3, SW4, SW6 and SW7 are switched on. When the transmitter 310 and the receiver 320 are set to be operated in the CMRS mode, the switches SW1, SW2 and SW5 are switched on, and the switches SW3, SW4, SW6 and SW7 are switched off. The operations of the TTL mode and the SMRS mode are described as follows:

When the transmitter 310 and the receiver 320 are operated in the TTL mode, the switches SW1, SW2 and SW5 are switched off, and the switches SW3, SW4, SW6 and SW7 are switched on, and an equivalent circuit diagram of the transmitter 310 and the receiver 320 is shown in FIG. 5. As shown in FIG. 5, the inverter 312 receives an input signal $V_i$, at an input node $N_{IN_TX}$ and generates a digital signal $V_{dig}$ at an output node $N_{OUT_TX}$, and the digital signal $V_{dig}$ is then transmitted to an input node $N_{IN_RX}$ of the receiver 320 via the single data line. The switches $M_{P2}$ and $M_{N2}$ serve as an inverter, and the switch $M_{P2}$ selectively connects an output node $N_{OUT_RX}$ of the receiver 320 to a reference voltage $V_{DD_RX}$ based on the digital signal $V_{dig}$, and the switch $M_{N2}$ selectively connects the output node $N_{OUT_RX}$ of the receiver 320 to a reference voltage GND based on the digital signal $V_{dig}$, and an output signal $V_{out}$ at the output node $N_{OUT_RX}$ is generated. Then, the inverter 324 inverts the output signal $V_{out}$ to generate an inverted output signal $V_{outb}$. Finally, a channel in the source driver generates a driving voltage based on the inverted output signal $V_{outb}$.

Figure 6:
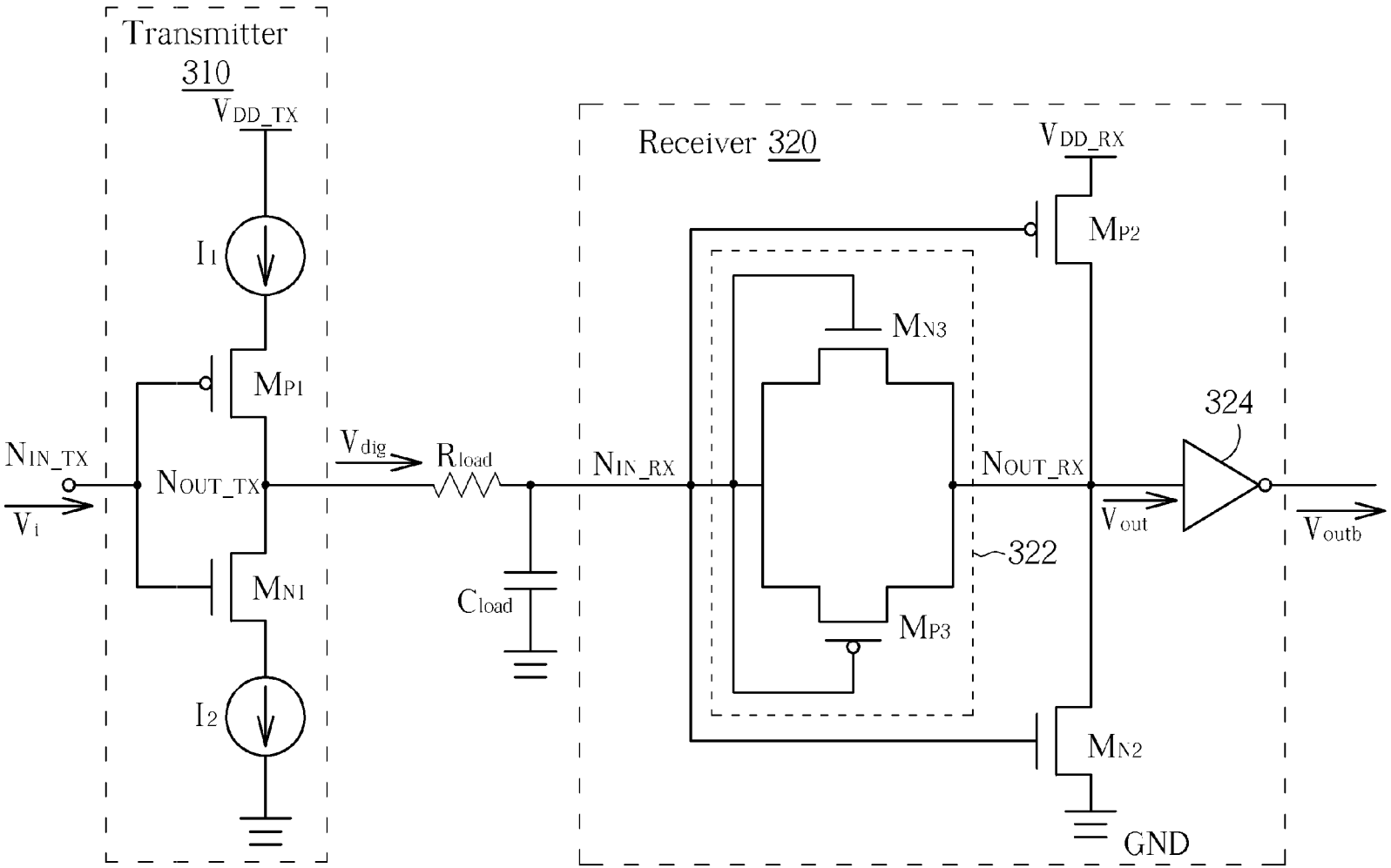
FIG. 6 is an equivalent circuit of the transmitter in the timing controller and the receiver in the source driver shown in FIG. 3 when it is in a CMRS mode.

When the transmitter 310 and the receiver 320 are operated in the CMRS mode, the switches SW1, SW2 and SW5 are switched on, and the switches SW3, SW4, SW6 and SW7 are switched off, and an equivalent circuit diagram of the transmitter 310 and the receiver 320 is shown in FIG. 6. As shown in FIG. 6, the P-type transistor MP1 and the N-type transistor MN1 serve as an inverter, for receiving an input signal $V_i$, at an input node $N_{IN_TX}$ and generating a digital signal $V_{dig}$ at an output node $N_{OUT_TX}$, and the digital signal $V_{dig}$ is then transmitted to an input node $N_{IN_RX}$ of the receiver 320 via the single data line. The switch $M_{P2}$ selectively connects an output node $N_{OUT_RX}$ of the receiver 320 to the reference voltage $V_{DD_RX}$ based on the digital signal $V_{dig}$, and the switch $M_{N2}$ selectively connects the output node $N_{OUT_RX}$ of the receiver 320 to the reference voltage GND based on the digital signal $V_{dig}$, and an output signal $V_{out}$ at the output node $N_{OUT_RX}$ is generated. At the same time, the voltage-limiting circuit 322 limits a voltage level of the input node $N_{IN_RX}$ of the receiver 320. Then, the inverter 324 inverts the output signal $V_{out}$ to generate an inverted output signal $V_{outb}$. Finally, a channel in the source driver generates a driving voltage based on the inverted output signal $V_{outb}$.

For example, when the input signal $V_i$, is at a state of logic "0" (lower voltage level), the current path between the transmitter 310 and the receiver 320 is from the current source $I_1$, and through the P-type transistor $M_{P1}$, the single data line, the input node $N_{IN_RX}$ of the receiver 320, the N-type transistor $M_{N3}$, the N-type transistor $M_{N2}$, and eventually into a node having the reference voltage GND. At this time, the voltage level of the input node $N_{IN_RX}$ of the receiver 320 is a summation of a drain-source voltage $V_{DS}$ of the N-type transistor $M_{N3}$ and a gate-source voltage $V_{GS}$ of the N-type transistor $M_{N2}$, and is less than the reference voltage $V_{DD_TX}$ of the transmitter 310. The output node $N_{OUT_RX}$ of the receiver 320 is at the lower voltage level. The threshold voltages of the transistor $M_{N3}$ and $M_{N2}$ are properly designed such that the voltage level of the input node $N_{IN_RX}$ is large enough, at this state, to turn off the transistor $M_{P2}$, so as to prevent transistors $M_{P2}$ and $M_{N2}$ from simultaneously being turned on.

Similarly, when the input signal $V_i$, is at a state of logic "1" (higher voltage level), the current path in the transmitter 310 and the receiver 320 is from the P-type transistor $M_{P2}$, and through the output node $N_{OUT_RX}$ of the receiver 320, the P-type transistor $M_{P3}$, the input node $N_{IN_RX}$ of the receiver 320, the single data line, the N-type transistor $M_{N1}$, the current source $I_2$, and eventually into the ground. At this time, the voltage level of the input node $N_{IN_RX}$ of the receiver 320 is a difference between the first reference voltage $V_{DD_RX}$ and a summation of a drain-source voltage $V_{DS}$ of the P-type transistor $M_{P2}$ and a gate-source voltage $V_{GS}$ of the P-type transistor $M_{P3}$, and is greater than the ground voltage of the transmitter 310. The output node $N_{OUT_RX}$ of the receiver 320 is at a higher voltage level. The threshold voltages of the transistor $M_{P3}$ and $M_{P2}$ are properly designed such that the voltage level of the input node $N_{IN_RX}$ is small enough, at this state, to turn off the transistor $M_{N2}$, so as to prevent transistors $M_{P2}$ and $M_{N2}$ from simultaneously being turned on.

Taking 1.8 volts as $V_{DD_RX}$ and $V_{DD_TX}$, a swing of the digital signal $V_{dig}$ of the present invention is about 1 volt (0.4V-1.4V), which is much lower than the swing (0-1.8V) of the signal in the TTL 100. Therefore, the display provided by the present invention has better EMI and operating frequency. Furthermore, because the receiver 320 is connected to the transmitter 310 via the single data line, the layout is less complex.

In addition, in the circuit 200, the current sources $I_{S1}$ and $I_{S2}$ in the transmitter 210 require higher supply currents (about 2 mA) to the data lines to maintain the constant voltage on the data lines. In the present invention, however, the constant voltage (a middle voltage of the digital signal $V_{dig}$) is generated by the transmitter 310 and the receiver 320 themselves. Therefore, the current source $I_1$, and $I_2$ only need to supply currents of about 100 uA to the single data line to maintain the constant voltage.

It is noted that, in the present invention, the transmitter 310 is implemented in the timing controller. However, this arrangement is for illustrative purposes only and is not intended to limit the implementation at the timing controller. The transmitter 310 can be implemented between any control circuit and the source driver, and these alternative designs are all within the scope of the present invention.

In addition, in this embodiment, the receiver 320 includes the inverter 324 and the channel in the source driver generates the driving voltage based on the inverted output signal $V_{outb}$. However, in other embodiments of the present invention, the inverter 324 can be removed from the receiver 320, and the channel in the source driver generates the driving voltage based on the output signal $V_{out}$.

Figure 7:
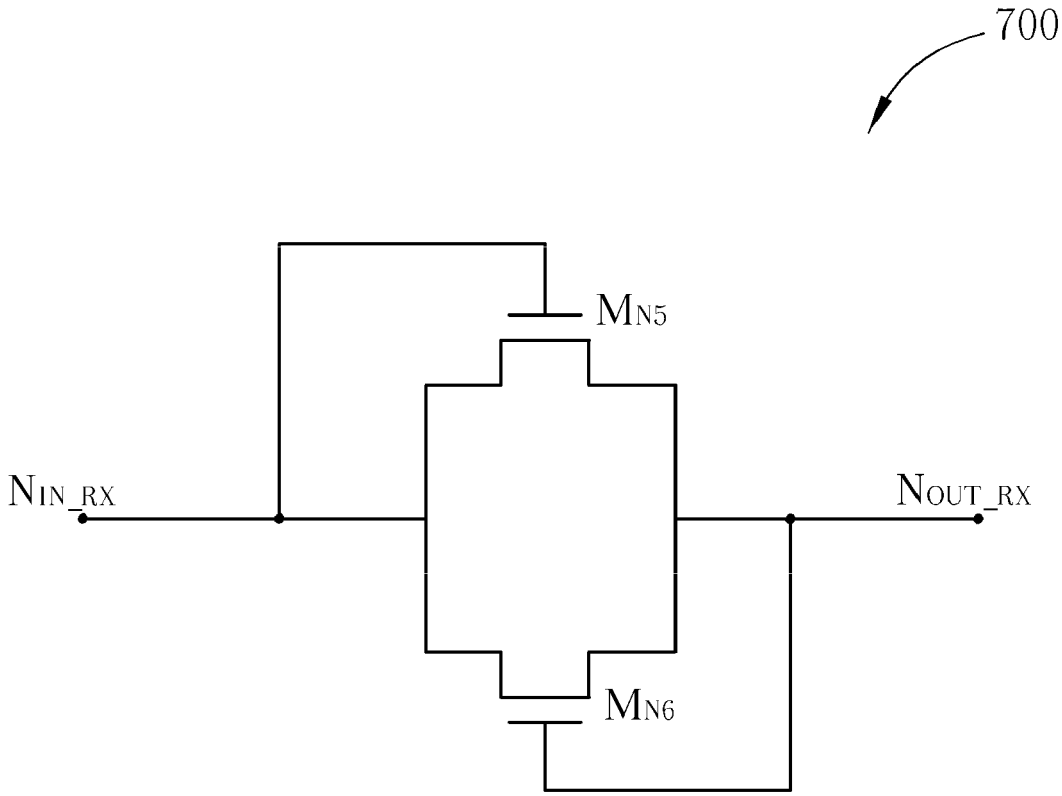
FIG. 7 is another embodiment of the voltage-limiting circuit shown in FIG. 3.
Figure 8:
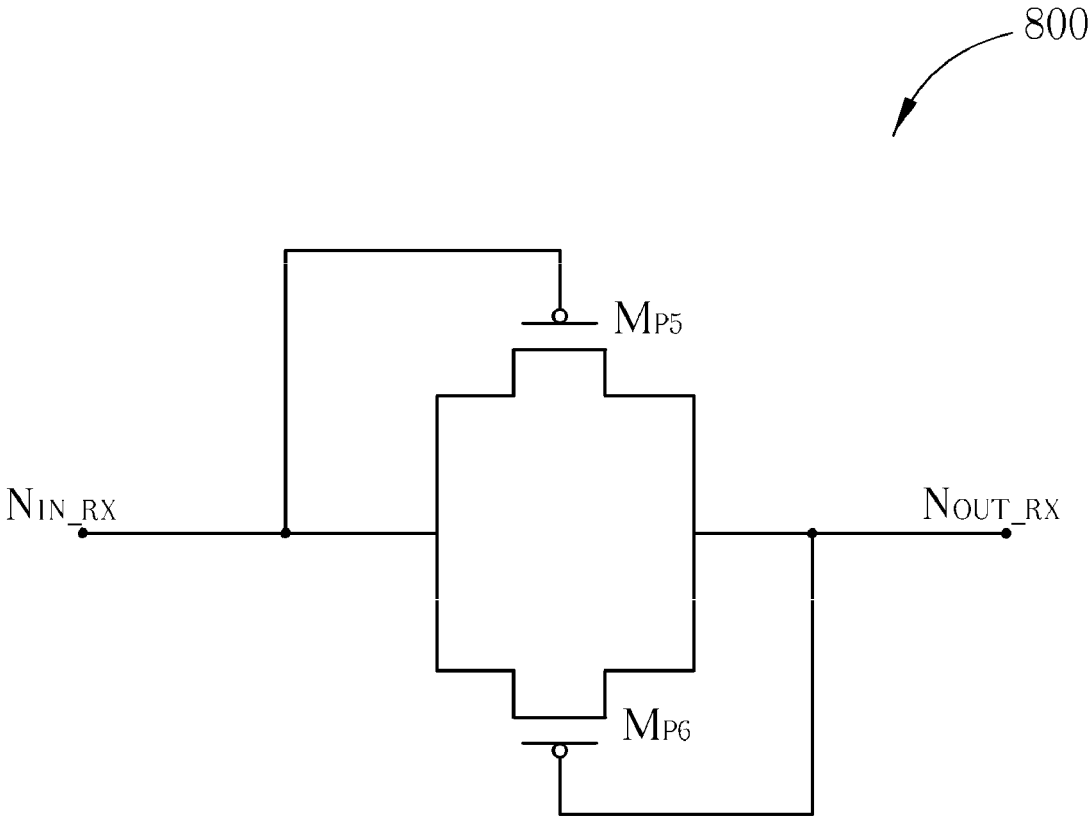
FIG. 8 is a further embodiment of the voltage-limiting circuit shown in FIG. 3.

FIG. 7 and FIG. 8 are other embodiments of the voltage-limiting circuit of the present invention. In FIG. 7, a voltage-limiting circuit 700 includes two N-type transistors $M_{N5}$ and $M_{N6}$, where the N-type transistors $M_{N54}$ and $M_{N6}$ are diode-connected and coupled between the input node $N_{IN_RX}$ and the output node $N_{OUT_RX}$ of the receiver 320, a gate electrode of the N-type transistor $M_{N5}$ is connected to the input node $N_{IN_RX}$ of the receiver 320, and a gate electrode of the N-type transistor $M_{N6}$ is connected to the output node $N_{OUT_RX}$ of the receiver 320. In FIG. 8, a voltage-limiting circuit 800 includes two P-type transistors $M_{P5}$ and $M_{P6}$, where the P-type transistors $M_{P5}$ and $M_{P6}$ are diode-connected and coupled between the input node $N_{IN_RX}$ and the output node $N_{OUT_RX}$ of the receiver 320, and a gate electrode of the P-type transistor $M_{P4}$ is connected to the input node $N_{IN_RX}$ of the receiver 320, and a gate electrode of the second P-type transistor $M_{P5}$ is connected to the output node $N_{OUT_RX}$ of the receiver 320.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A source driver, comprising:

a receiver for receiving a digital signal at an input node to generate an output signal at an output node, comprising:

a first switch, for selectively connecting the output node of the receiver to a first reference voltage based on the digital signal;

a second switch, for selectively connecting the output node of the receiver to a second reference voltage based on the digital signal;

a voltage-limiting circuit, coupled between the input node and the output node of the receiver, for limiting a voltage level of the input node of the receiver;

a third switch, coupled between the voltage-limiting circuit and the output node of the receiver; and a channel, for generating a driving voltage based on the output signal.

2. The source driver of claim 1, wherein the receiver further comprises:

an inverter coupled between the output node and the channel.

3. The data transmission system of claim 1, wherein the voltage-limiting circuit comprises:

a diode-connected transistor coupled between the input node and the output node of the receiver.

4. The data transmission system of claim 1, wherein the voltage-limiting circuit includes:

a P-type transistor coupled between the input node and the output node of the receiver, wherein a gate terminal of the P-type transistor is connected to the input node of the receiver; and an N-type transistor coupled between the input node and the output node of the receiver, wherein a gate terminal of the N-type transistor is connected to the input node of the receiver.

5. The source driver of claim 1, wherein the voltage-limiting circuit includes:

a first N-type transistor coupled between the input node and the output node of the receiver, wherein a gate terminal of the first N-type transistor is connected to the input node of the receiver; and a second N-type transistor coupled between the input node and the output node of the receiver, wherein a gate terminal of the second N-type transistor is connected to the output node of the receiver.

6. The source driver of claim 1, wherein the voltage-limiting circuit includes:

a first P-type transistor coupled between the input node and the output node of the receiver, wherein a gate terminal of the first P-type transistor is connected to the input node of the receiver; and a second P-type transistor coupled between the input node and the output node of the receiver, wherein a gate terminal of the second P-type transistor is connected to the output node of the receiver.

7. The source driver of claim 1, wherein the first switch is a P-type transistor, the second switch is an N-type transistor, and the first reference voltage is greater than the second reference voltage.

8. A display comprising:

a timing controller for receiving an input signal at an input node and generating a digital signal at an output node, comprising:

a first P-type transistor, coupled between a first current source and the output node of the timing controller;

a first N-type transistor, coupled between a second current source and the output node of the timing controller;

a first switch, coupled between a gate electrode of the P-type transistor and the input node of the timing controller;

a second switch, coupled between a gate electrode of the N-type transistor and the input node of the timing controller;

a third switch, coupled between the gate electrode of the P-type transistor and a first reference voltage;

a fourth switch, coupled between the gate electrode of the N-type transistor and a second reference voltage; and an inverter, coupled between the input node and the output node of the timing controller; and a source driver comprising a receiver, coupled to the output node of the timing controller via a single data line, for receiving the digital signal from the timing controller via the single data line.

9. The display of claim 8, wherein the receiver is utilized for receiving the digital signal at an input node of the receiver to generate an output signal at an output node of the receiver, further comprising:

a fifth switch, for selectively connecting the output node of the receiver to a third reference voltage based on the digital signal;

a sixth switch, for selectively connecting the output node of the receiver to a fourth reference voltage based on the digital signal;

a voltage-limiting circuit, coupled between the input node and the output node of the receiver, for limiting a voltage level of the input node of the receiver;

a seventh switch, coupled between the voltage-limiting circuit and the output node of the receiver; and a channel, for generating a driving voltage based on the output signal.

10. The display of claim 9, wherein the receiver further comprises:

an inverter coupled between the output node of the receiver and the channel.

11. The display of claim 9, wherein the voltage-limiting circuit comprises:

a diode-connected transistor coupled between the input node and the output node of the receiver.

12. The display of claim 9, wherein the voltage-limiting circuit includes:

a second P-type transistor coupled between the input node and the output node of the receiver, wherein a gate electrode of the second P-type transistor is connected to the input node of the receiver; and a second N-type transistor coupled between the input node and the output node of the receiver, wherein a gate electrode of the N-type transistor is connected to the input node of the receiver.

13. The display of claim 9, wherein the voltage-limiting circuit includes:

a second N-type transistor coupled between the input node and the output node of the receiver, wherein a gate electrode of the second N-type transistor is connected to the input node of the receiver; and a third N-type transistor coupled between the input node and the output node of the receiver, wherein a gate electrode of the third N-type transistor is connected to the output node of the receiver.

14. The display of claim 9, wherein the voltage-limiting circuit includes:

a second P-type transistor coupled between the input node and the output node of the receiver, wherein a gate electrode of the second P-type transistor is connected to the input node of the receiver; and a third P-type transistor coupled between the input node and the output node of the receiver, wherein a gate electrode of the third P-type transistor is connected to the output node of the receiver.

15. The display of claim 9, wherein the fifth switch is a P-type transistor, the sixth switch is an N-type transistor, and the third reference voltage is greater than the fourth reference voltage.

* * * * *